United States Patent [19]

Wren

[11] Patent Number: 4,480,256

[45] Date of Patent: Oct. 30, 1984

[54] MICROWAVE ABSORBER

[75] Inventor: Lloyd W. Wren, Valley Center, Kans.

[73] Assignee: Boeing Company, Seattle, Wash.

[21] Appl. No.: 478,203

[22] Filed: Mar. 23, 1983

Related U.S. Application Data

[63] Continuation-in-part of Ser. No. 294,046, Aug. 18, 1981, Pat. No. 4,381,510.

[51] Int. Cl.[3] ..... H01Q 17/00

[52] U.S. Cl. ..... 343/909; 343/18 A

[58] Field of Search ..... 343/18 A, 18 R, 754, 343/872, 909

[56] References Cited

U.S. PATENT DOCUMENTS 3,633,206 1/1972 McMillan ..... 343/909

4,118,704 10/1978 Ishino et al. ..... 343/18 A 4,327,364 4/1982 Moore ..... 343/18 A

*Primary Examiner*—Eli Lieberman

*Attorney, Agent, or Firm*—Edwin H. Crabtree

[57] ABSTRACT

An improved microwave absorber for coupling and absorbing radio frequency energy used for communication, navigation and radar systems. The structure has a conformal energy receiving surface for receipt on reflecting surfaces or surfaces supporting unwanted surface waves. The microwave absorber provides an effective means for antenna radiation pattern control, reduction of antenna to antenna coupling caused by reflections or surface waves and improved low angle response with a minimal effect on high angle of incidence performance.

11 Claims, 7 Drawing Figures

MICROWAVE ABSORBER

BACKGROUND OF THE INVENTION

This patent application is a continuation-in-part of an application entitled "Microwave Absorber" by the same inventor having Ser. No. 294,046 and filed Aug. 18, 1981, now U.S. Pat. No. 4,381,510. The patent references cited during the prosecution of the above mentioned application are incorporated herein by reference.

The subject invention broadly includes a structure for coupling and absorbing radio frequency energy and more particularly but not by way of limitation to a microwave absorber having lossy covered leaky transmission lines for coupling energy arriving at various angles of incidence.

Heretofore, there have been different types of antennas and radomes having dielectric coverings and strips mounted thereon. Also, the antennas and radomes have different types of geometric configurations for receiving radio frequency energy. These types of radomes and antennas are disclosed in U.S. Pat. No. 4,189,731 to Rope et al, U.S. Pat. No. 4,086,591 to Siwiak et al, U.S. Pat. No. 3,448,455 to Alfrandari et al, U.S. Pat. No. 3,576,581 to Tricoles and U.S. Pat. No. 3,002,190 to Oleesky et al.

None of the above mentioned patents disclosed the unique features and advantages of a microwave absorber for coupling and absorbing radio frequency energy as described herein.

SUMMARY OF THE INVENTION

The improved microwave absorber is simple in design and is adapted for receipt on various types of reflecting surfaces. The absorber may have various dimensions and geometric designs selected to receive and couple incident radio frequency energy.

The absorber is effective for coupling and absorbing energy arriving at any angle of incidence and of any polarization and converting this energy to a propagating mode and preventing reradiation of the energy. Further the absorber provides improved low angle response with a minimal effect on high angle performance.

The absorber is effective for antenna radiation pattern control and reducing the coupling of reflections and surface waves between antennas. The invention may be used with various types of communication, navigation and radar systems and mounted on various types of aircraft, ships and vehicles.

The absorber includes an energy receiving surface which is adapted for receipt on a reflecting surface. A first transmission line wall is mounted on the receiving surface and has a lossy wall covering. A second transmission line wall is mounted on the receiving surface and has a lossy wall covering. The two walls are disposed in a spaced relationship to each other and form an open channel configuration with the receiving surface.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
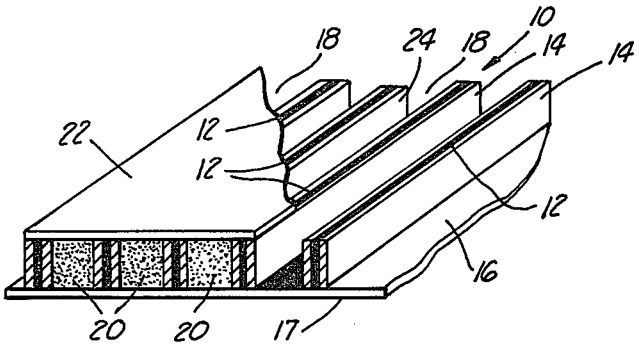
FIG. 1 illustrates the microwave absorber for mounting on a reflecting surface and coupling and absorbing radio frequency energy.

In FIG. 1 the improved microwave absorber is designated by general reference numeral 10. The absorber 10 includes a plurality of transmission line walls 12 having a lossy wall covering 14 disposed on opposite sides of the walls 12. The walls 12 are dimensionally and geometrically selected to couple incidence radio energy of any polaration and convert this energy to a propagating mode in and between the transmission line walls 12. The lossy covering 14 contained within the transmission line walls 12 will attenuate the fields associated with the propagating modes and thus prevent reradiation and reflection.

The walls 12 may be parallel or at an angle to each other and are mounted in an upright position on an energy receiving surface 16 which may be adapted for mounting on different types of reflective surfaces 17. The energy receiving surface 16 may or may not, as desired, include a lossy surface cover similar to the lossy wall coverings 14. The walls 12 and surface 16 are made of electrical conductive material and are in electrical contact to form an open channel 18.

The open channel 18 may be filled with a low density foam 20 and covered with a thin dielectric skin 22 to provide a smooth aerodynamic surface. The absorption measurements have shown negligible change in performance compared to the initial measurements without the foam 20 and skin 22.

It has been found the absorber 10 as described in FIG. 1 was less effective at lower angles of incidence than at high angles of incidence. Therefore, subsequent development as shown in FIGS. 2 through 6 has resulted in an improved absorber significantly more responsive to low angles of incidence with a minimal effect on high angle performace.

Figure 2:
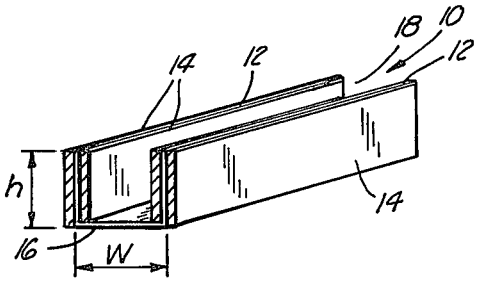
FIG. 2 illustrates the microwave absorber with various heights and width for different performance characteristics.

In FIG. 2 it is noted by the change of the height (h) of the wall 12 and varying the width (w) of the open channel configuration 18 modified performace characteristics of the improved absorber 10 may be obtained.

Figure 3:
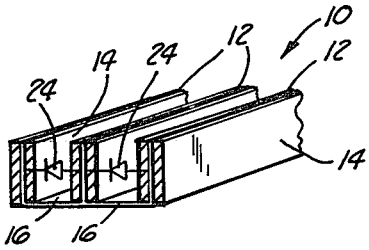
FIGS. 3 and 4 illustrate the mounting of semi-conductors across and along the length of the transmission line walls.
Figure 4:
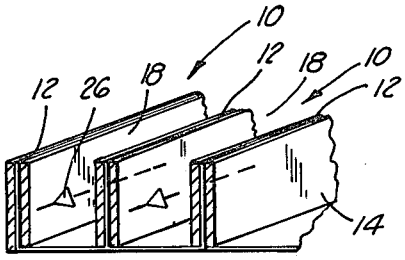

In FIG. 3 means is provided in the open channel configuration 18 for providing electrical modulation by the use of a plurality of semi-conductors 24 disposed laterally across the open channel configuration 18 of the absorber 10. Also electrical modulation may be obtained by positioning semi-conductors 26 along the length of the open channel configuration 18 as shown in FIG. 4.

Figure 5:
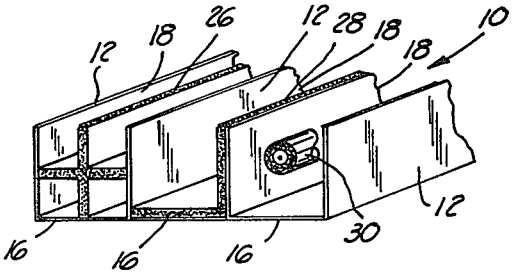
FIG. 5 illustrate the use of ferrite control elements mounted in the open channel configuration.

In FIG. 5 various configurations of ferrite control elements are disposed inside the open channel configuration 18 such as a cross configuration 26 and "L" shaped configuration 28 and an elongated rod configuration 30 all disposed within separate open channels 18. While these configurations are shown, it can be appreciated various types of configurations made of ferrite or similar type materials can be used without departing from the scope of the invention.

Figure 6:
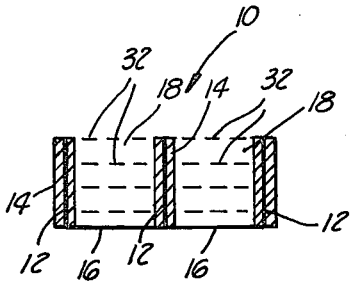
FIG. 6 illustrates the use of a thin lossy membrane of polyester matting inside the open channel configuration.

In the past it was thought the inclusion of a structure within the channels 18 which was an effective absorber at low angles of incidence would allow the resultant composite to accomodate these angles and that if the inserted structure was graduated in electrical properties such that the significant high angle of incident reflections from it did not occur until a mid or lower strata had been reached then the high angle of incident performance of the assembly could be obtained. Also, it seemed that the added structure might be made to serve an impedance matching function thereby improving the channels coupling characteristics. Therefore, to a layered structure consisting of very thin air spaced resistive lossy membranes 32 were placed parallel to the bottom of the channel 18 as shown in FIG. 6. The conductance of the outer layer membrane 32 would be low but would increase with each subsequent layer of membrane 32. The graduations in conductance and the layer spacings for optimal performance could be choosen in accordance with a desired response characteristics (i.e. exponential, binomial, etc.) considering the frequency range of bandwidth desired.

The concept as shown in FIG. 6 is provided by using layers of membranes 32 with a 0.003 inch thick polyester matting in which different proportions of graphite fibers have been included during manufacturing. The spacing between the layers was accomplished by using low density foam strips which are not shown in the drawings. The test results on this composite structure showed good performance at angles of incidence from normal to near grazing and over greater than octave frequency ranges.

Figure 7:
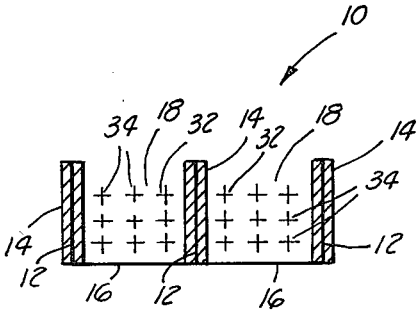
FIG. 7 illustrates the use of thin lossy membrane layers parallel to both the walls and the bottom of the open channel.

In FIG. 7 an extension of the concept shown in FIG. 6 is provided by the addition of another set of spaced membranes 34 each of which is graduated in conductance and placed parallel to the walls 14 of the channel 18. The conductance taper of each of these membranes 34 would increase with the depth into the channel 18 in accordance with some prescribed function. The benefits of the membranes 32 and 34 as shown in FIG. 6 and 7 provides decreased polarization sensitivity and the required channel loading is reduced and perhaps eliminated.

Changes may be made in the construction and arrangement of the parts or elements of the embodiments as described herein without departing from the spirit or scope of the invention defined in the following claims.

What is claimed is:

1. A microwave absorber for a reflecting surface, the absorber coupling and absorbing radio frequency energy at different angles of incidence, the absorber including:

an energy receiving surface adapted for receipt on the reflecting surface;

a first conducting transmission line wall mounted on the receiving surface;

a second conducting transmission line wall mounted on the receiving surface, the second transmission line wall disposed in a spaced relationship from the first transmission line wall, the receiving surface and the first and second wall forming an open channel configuration; and means disposed in the open channel configuration for modulation of the absorption of the frequency energy received therein.

2. The absorber as described in claim 1 wherein the first and second transmission line walls are parallel to each other.

3. The absorber as described in claim 1 wherein the first and second transmission line walls are positioned at an angle to each other.

4. The absorber as described in claim 1 wherein the means for modulation of the frequency energy is one or more semi-conductors placed parallel to the length of the open channel configuration.

5. The absorber as described in claim 1 wherein the means for modulation of the frequency energy is one or more semi-conductors placed perpendicular to the length of the open channel configuration.

6. The absorber as described in claim 1 wherein the means for modulation of the frequency energy is a ferrite control element disposed along the length of the open channel configuration.

7. A microwave absorber for a reflecting surface, the absorber coupling and absorbing radio frequency energy at different angles of incidence, the absorber including:

an energy receiving surface adapted for receipt on the reflecting surface;

a first conducting transmission line wall mounted on the receiving surface;

a second conducting transmission line mounted on the receiving surface, the second transmission line wall disposed in a space relationship from the first transmission line wall, the receiving surface and the first and second wall forming an open channel configuration; and means disposed in open channel configuration for graduated absorption of the frequency energy received therein.

8. The absorber as described in claim 7 wherein the means for graduated absorption of the frequency energy is a plurality of layers of lossy membranes disposed along the length of the open channel configuration and having air spaces therebetween.

9. The absorber as described in claim 8 wherein the lossy membranes include a polyester matting having graphite fibers woven therein.

10. The absorber as described in claim 9 wherein the polyester matting is disposed parallel to the bottom of the open channel configuration.

11. The absorber as described in claim 9 wherein the polyester matting is disposed parallel to the first and second transmission conducting line walls.

* * * * *